US006071170A

United States Patent [19]

How

[11] Patent Number: 6,071,170

[45] Date of Patent: Jun. 6, 2000

[54] DANCING TOY DEVICE

[76] Inventor: Chin-Jung How, 58, Ma Yuan West St., Taichung, Taiwan

[21] Appl. No.: 09/232,255

[22] Filed: Jan. 19, 1999

[51] Int. Cl.[7] ..... A63H 3/20; A63H 13/00; G09F 19/08

[52] U.S. Cl. ..... 446/330; 446/354; 40/418

[58] Field of Search ..... 446/3, 330, 351–354, 446/357, 486; 40/411, 414, 418–420

[56] References Cited

U.S. PATENT DOCUMENTS

| | | | |
|---|---|---|---|
| 3,964,205 | 6/1976 | Kuramochi . | |
| 5,147,238 | 9/1992 | Kelley et al. | 446/330 |
| 5,176,560 | 1/1993 | Wetherall et al. | 446/175 |

*Primary Examiner*—Robert A. Hafer
*Assistant Examiner*—Laura Fossum

[57] ABSTRACT

A dancing toy device has a trunk, a head portion connected to the trunk, and a base portion connected to the trunk. An outer casing covers the trunk. The base portion has a base panel, two pivot joint devices connected to the trunk, and two connection limbs connected to the pivot joint devices. The connection limbs are disposed on the base panel. A drive mechanism is disposed in a center portion of the trunk. The drive mechanism has a power device, a rotating plate, a displacement plate, a fixed plate, a drive plate, and a driven plate. A first vibration device is disposed in a lower portion of the trunk. A second vibration device is disposed in an upper portion of the trunk.

1 Claim, 6 Drawing Sheets

DANCING TOY DEVICE

BACKGROUND OF THE INVENTION

The present invention relates to a dancing toy device. More particularly, the present invention relates to a dancing toy device with a plurality of vibrating limbs.

Most conventional toy device cannot be vibrated with two or more articles thereon. It is difficult to vibrate an article on a toy. It is very difficult to vibrate a plurality of articles on a toy also.

SUMMARY OF THE INVENTION

An object of the present invention is to provide a dancing toy device in order to vibrate a plurality of limbs thereon.

Another object of the present invention is to provide a dancing toy device which has a drive mechanism and at least a vibration device in order to vibrate a plurality of limbs.

Accordingly, a dancing toy device comprises a trunk, a head portion connected to the trunk, and a base portion connected to the trunk. The base portion has a base panel, two pivot joint devices connected to the trunk, and two connection limbs connected to the pivot joint devices. The connection limbs are disposed on the base panel. A drive mechanism is disposed in a center portion of the trunk. The drive mechanism has a power device, a rotating plate, a displacement plate, a fixed plate, a drive plate, and a driven plate. A rotating shaft is inserted through the power device. The rotating plate is disposed on the rotating shaft. The displacement plate has a center recess receiving the rotating plate, a first oblong hole, and a second oblong hole. The first oblong hole receives a first support rod. The second oblong hole receives a second support rod. A center rod is disposed on the displacement plate. The fixed plate is disposed on the power device. A support post is disposed on a center of the fixed plate. The support post is connected to an end of the drive plate. The drive plate has a plurality of teeth. An oblong slot is formed on the drive plate. The center rod is inserted in the oblong slot. The driven plate is connected to the trunk. The driven plate has a plurality of serrations engaging with the teeth. A first vibration device is disposed in a lower portion of the trunk. The first vibration device has two sector plates and two positioning devices disposed on the sector plates. Two ends of a tension spring are positioned by the positioning devices. Each of the sector plates has a toothed edge. Each of the sector plates is connected to the respective pivot joint device. The sector plates engage with each other. A second vibration device is disposed in an upper portion of the trunk. The second vibration device has two vibrating arms, two suspension posts connected to the vibrating arms, two pivot rods connected to the suspension posts, two gears disposed in the trunk, two rotating wheels disposed on the gears, two pinions disposed on the pivot rods, and a driven panel disposed in the trunk and between the gears. Each of the rotating wheels has a serrated portion engaging with the pinions. The driven panel has two serrated edges engaging with the gears.

DETAILED DESCRIPTION OF THE INVENTION

Figure 1:
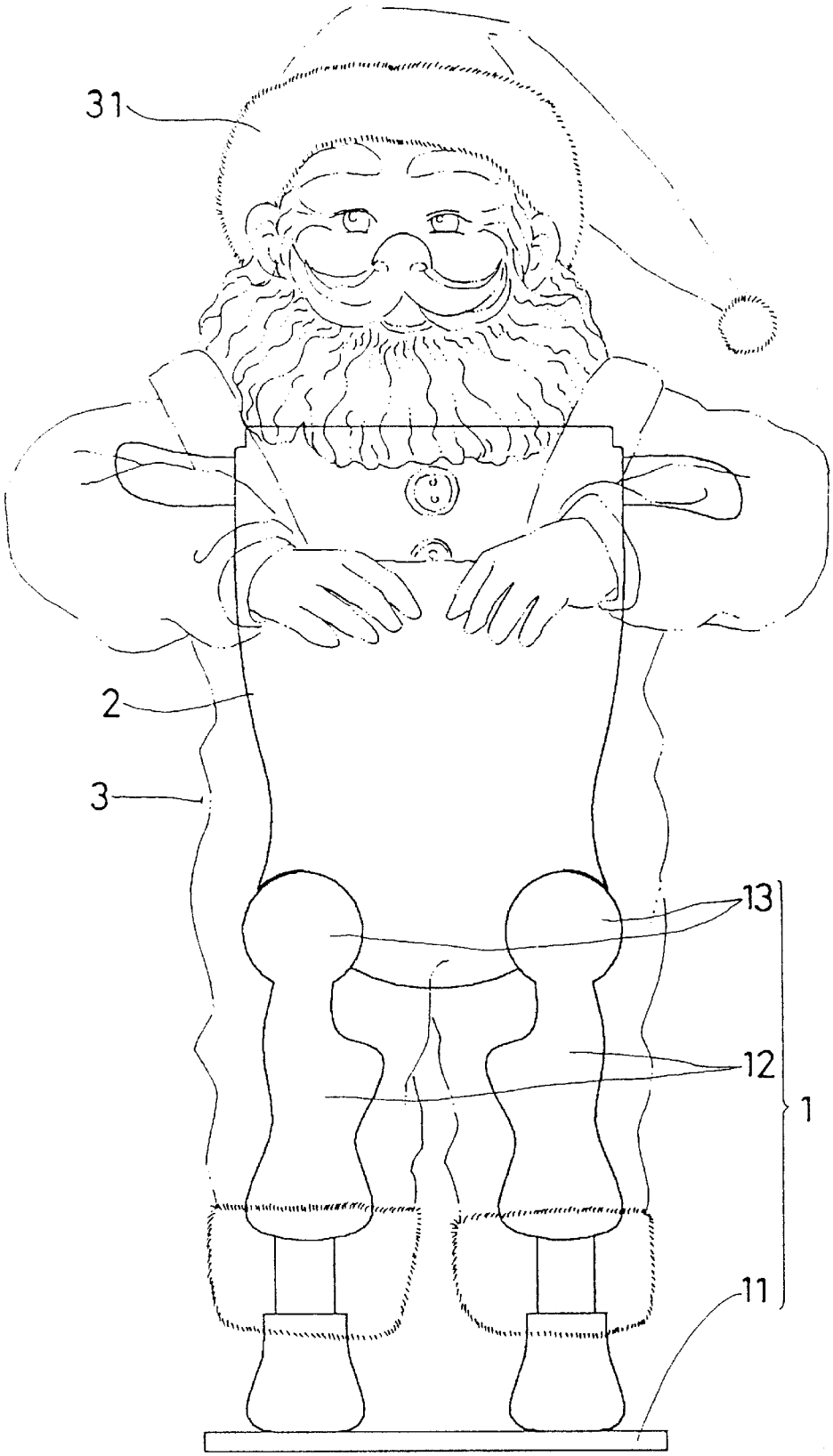
FIG. 1 is a front elevational view of a dancing toy device of a preferred embodiment in accordance with the present invention.
Figure 2:
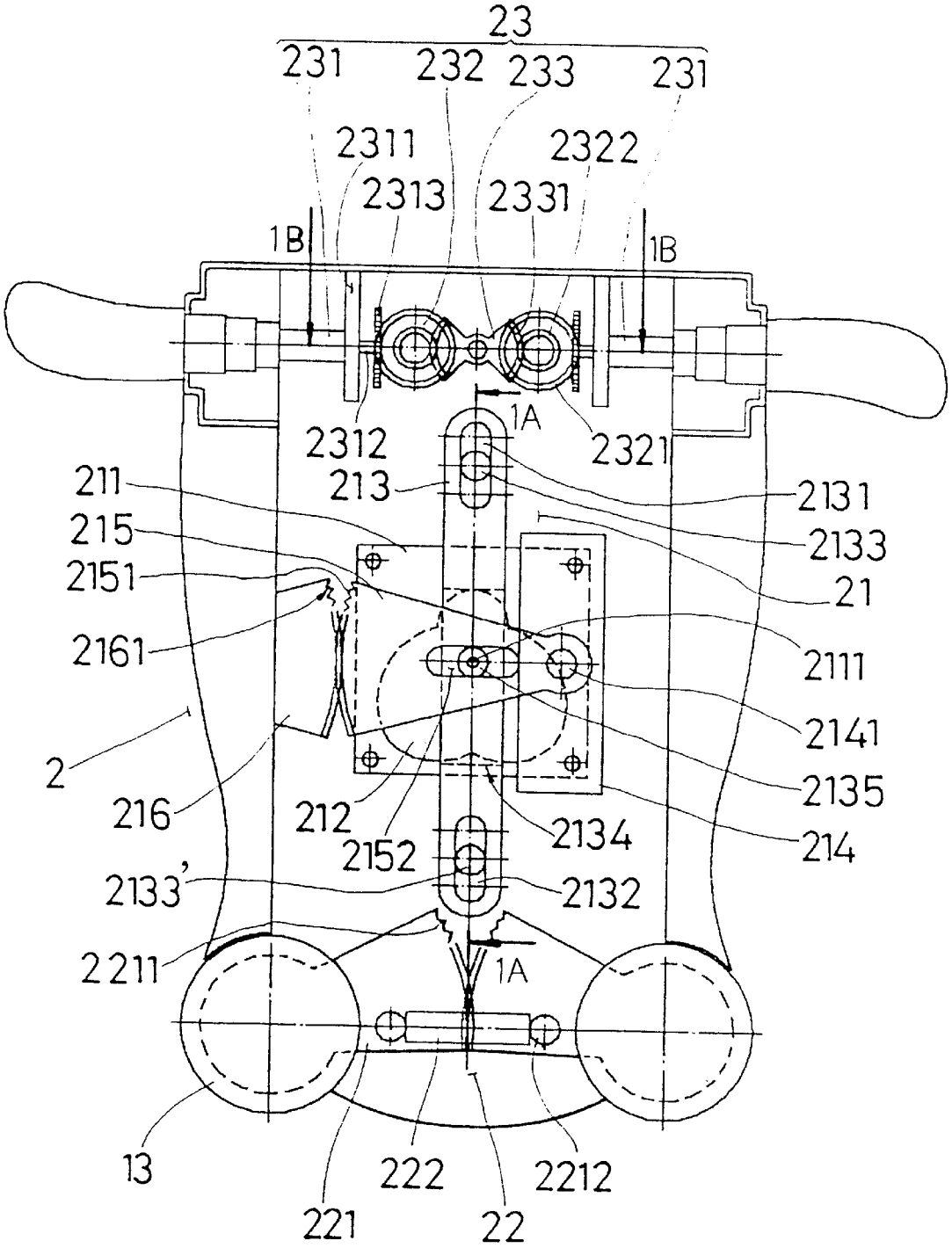
FIG. 2 is a schematic view illustrating an interior of a trunk of a preferred embodiment in accordance with the present invention.
Figure 4:
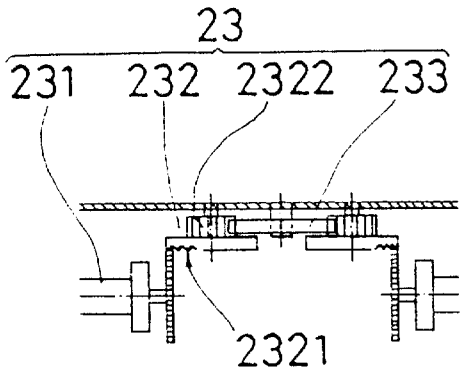
FIG. 4 is a partially sectional view of a trunk taken along line 1B—1B in FIG. 2.
Figure 3:
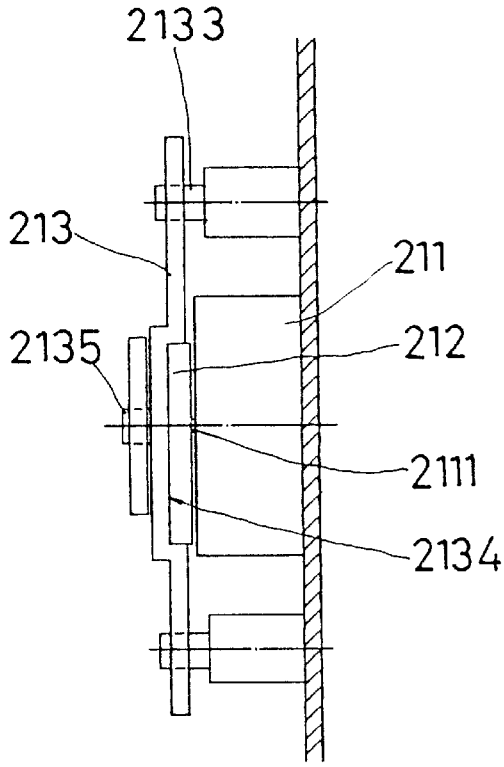
FIG. 3 is a partially sectional view of a trunk taken along line 1A—1A in FIG. 2.
Figure 5:
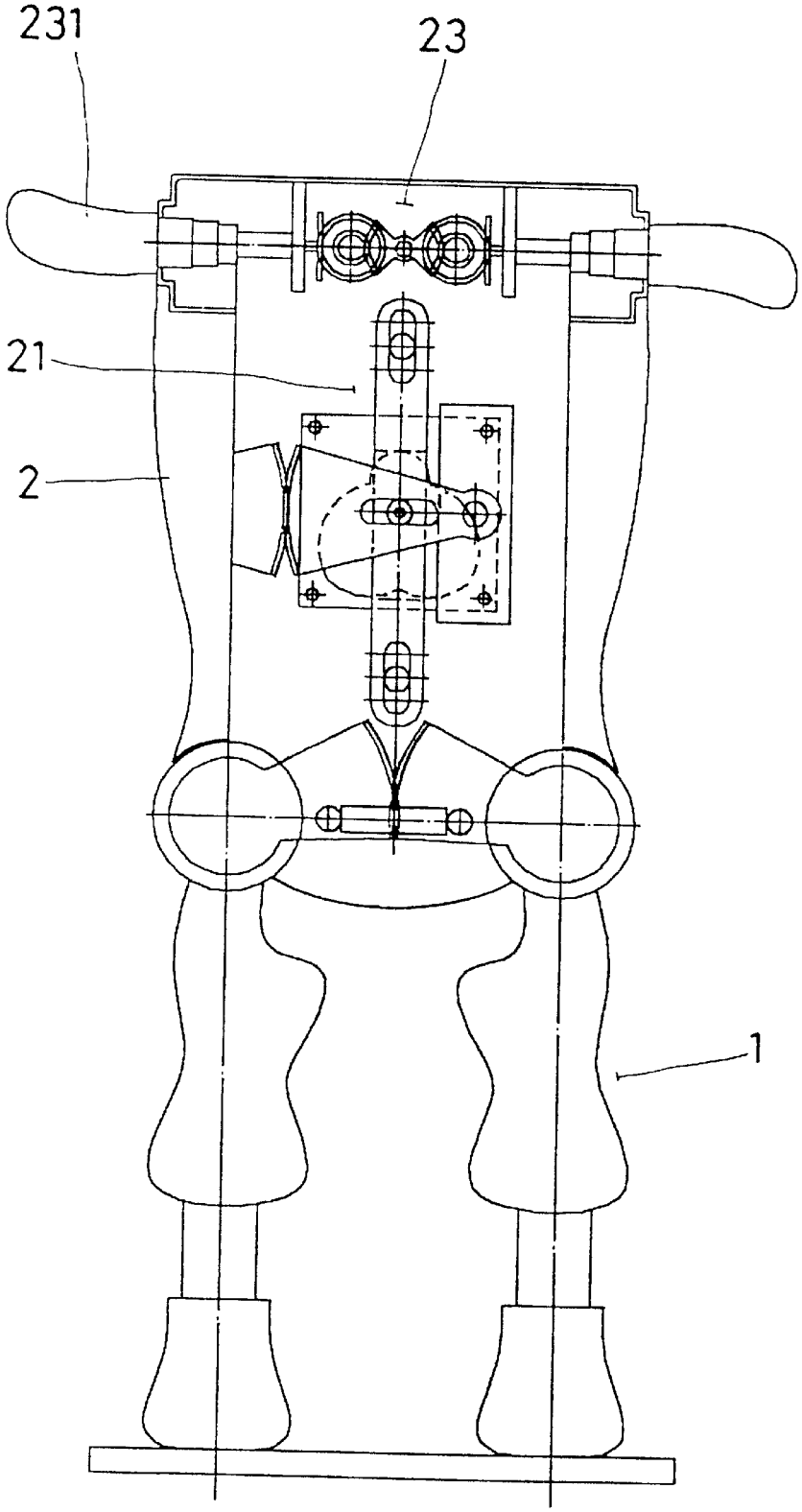
FIG. 5 is a partially schematic view of a dancing toy device of a preferred embodiment while the dancing toy device is not operated.

Referring to FIGS. 1 to 5, a dancing toy device comprises a trunk 2, a head portion 31 connected to the trunk 2, and a base portion 1 connected to the trunk 2. An outer casing 3 covers the trunk 2.

The base portion 1 has a base panel 11, two pivot joint devices 13 connected to the trunk 2, and two connection limbs 12 connected to the pivot joint devices 13. The connection limbs 12 are disposed on the base panel 11.

A drive mechanism 21 is disposed in a center portion of the trunk 2. The drive mechanism 21 has a power device 211, a rotating plate 212, a displacement plate 213, a fixed plate 214, a drive plate 215, and a driven plate 216. A motor (not shown in the figures) is disposed in the power device 211. A rotating shaft 2111 is inserted through the power device 211. The rotating plate 212 is disposed on the rotating shaft 2111. The displacement plate 213 has a center recess 2134 receiving the rotating plate 212, a first oblong hole 2131, and a second oblong hole 2132. The first oblong hole 2131 receives a first support rod 2133. The second oblong hole 2132 receives a second support rod 2133'. A center rod 2135 is disposed on the displacement plate 213. The fixed plate 214 is disposed on the power device 211. A support post 2141 is disposed on a center of the fixed plate 214. The support post 2141 is connected to an end of the drive plate 215. The drive plate 215 has a plurality of teeth 2151. An oblong slot 2152 is formed on the drive plate 215. The center rod 2135 is inserted in the oblong slot 2152. The driven plate 216 is connected to the trunk 2. The driven plate 216 has a plurality of serrations 2161 engaging with the teeth 2151.

A first vibration device 22 is disposed in a lower portion of the trunk 2. The first vibration device 22 has two sector plates 221 and two positioning devices 2212 disposed on the sector plates 221. Two ends of a tension spring 222 are positioned by the positioning devices 2212. Each of the sector plates 221 has a toothed edge 2211. Each of the sector plates 221 is connected to the respective pivot joint device 13. The sector plates 221 engage with each other.

A second vibration device 23 is disposed in an upper portion of the trunk 2, The second vibration device 23 has two vibrating arms 231, two suspension posts 2311 connected to the vibrating arms 231, two pivot rods 2312 connected to the suspension posts 2311, two gears 2322 disposed in the trunk 2, two rotating wheels 232 disposed on the gears 2322, two pinions 2313 disposed on the pivot rods 2312, and a driven panel 233 disposed in the trunk 2 and between the gears 2322. Each of the rotating wheels 232 has a serrated portion 2331 engaging with the pinions 2313. The driven panel 233 has two serrated edges 2331 engaging with the gears 2322.

Figure 6:
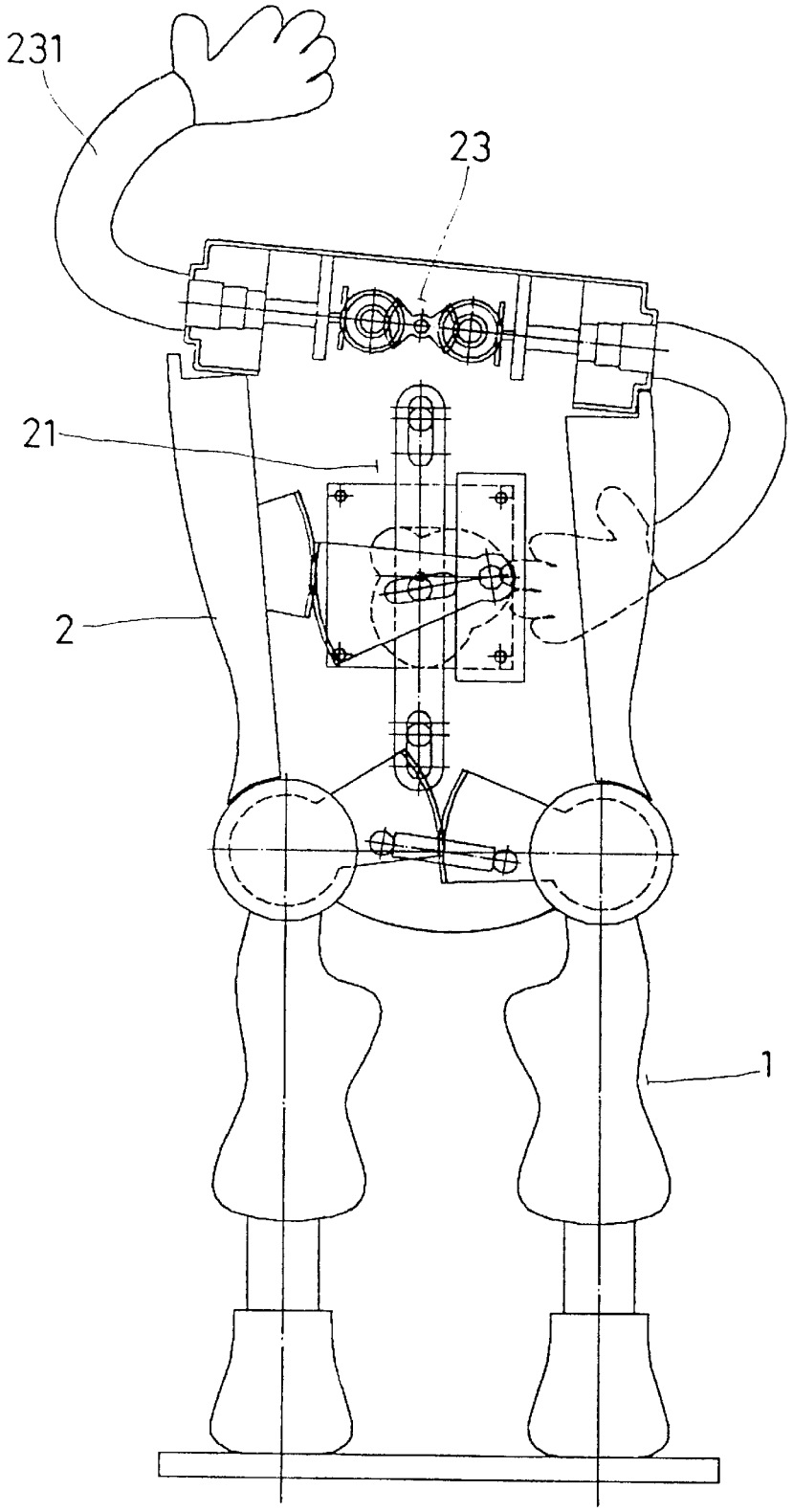
FIG. 6 is a partially schematic view of a dancing toy device of a preferred embodiment while the dancing toy device is operated.
Figure 7:
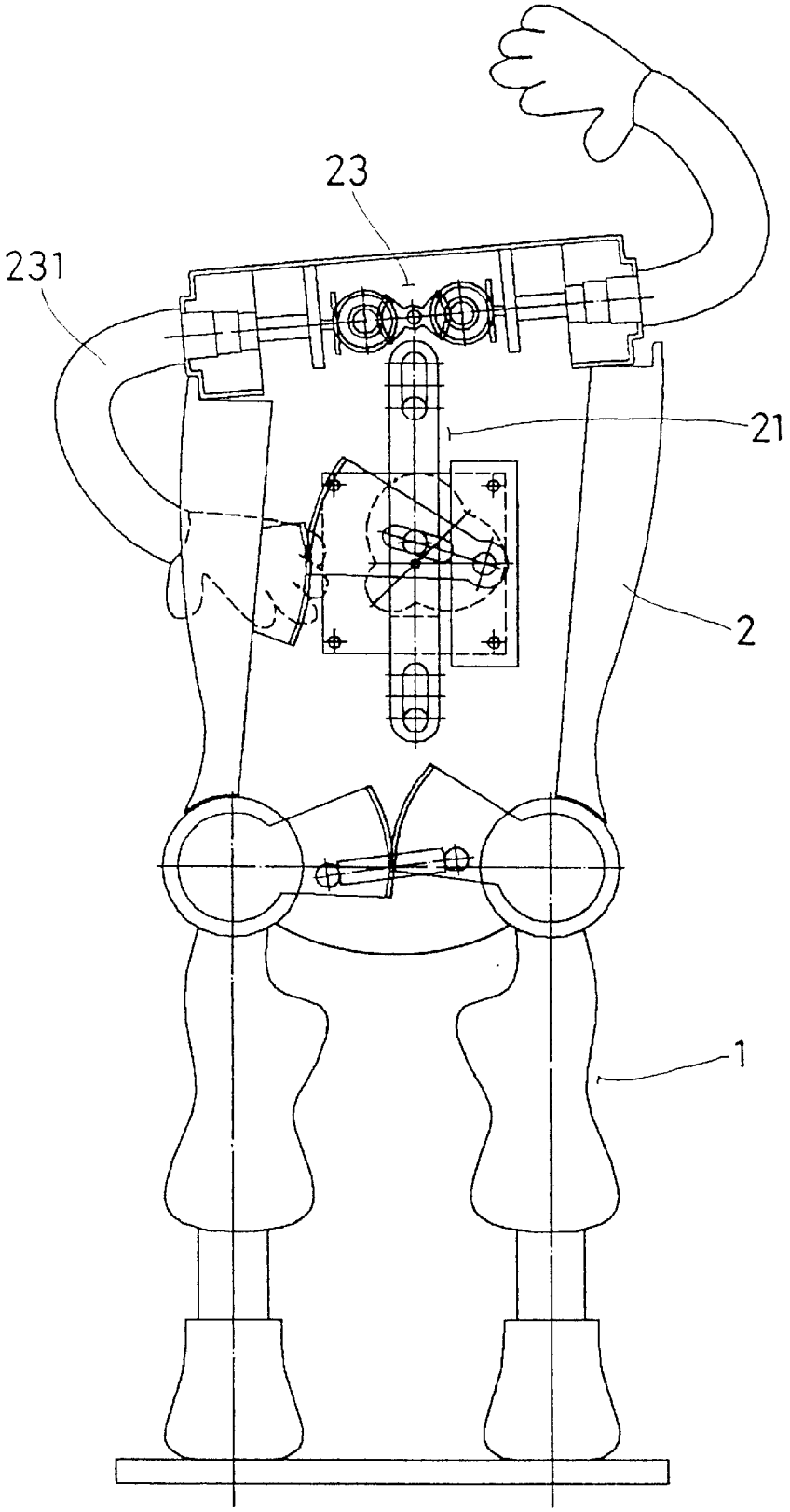
FIG. 7 is another partially schematic view of a dancing toy device of a preferred embodiment while the dancing toy device is operated.

Referring to FIGS. 6 and 7, the rotating shaft 2111 is rotated by the power device 211. The rotating plate 212 is rotated by the rotating shaft 2111. When the rotating plate 212 rotates, the displacement plate 213 moves upward and downward. The center rod 2135 drives the drive plate 215 to vibrate. The drive plate 215 drives the driven plate 216 to vibrate. Thus the trunk 2 on the left side moves upward and downward. When the trunk 2 on the left side moves upward, the pinion 2313 on the left side drives the rotating wheel 232 on the left side to rotate. The rotating wheel 232 on the left side drives the gear 2322 on the left side and the driven panel 233 to rotate clockwise.

When the trunk 2 on the right side moves upward, the pinion 2313 on the right side drives the rotating wheel 232 on the right side to rotate. The rotating wheel 232 on the right side drives the gear 2322 on the right side and the driven panel 233 to rotate counterclockwise.

The invention is not limited to the above embodiment but various modification thereof may be made. Further, various changes in form and detail may be made without departing from the scope of the invention.

I claim:

1. A dancing toy device comprising:

a trunk, a head portion connected to the trunk, a base portion connected to the trunk, the base portion having a base panel, two pivot joint devices connected to the trunk, and two connection limbs connected to the pivot joint devices, the connection limbs disposed on the base panel, a drive mechanism disposed in a center portion of the trunk, the drive mechanism having a power device, a rotating plate, a displacement plate, a fixed plate, a drive plate, and a driven plate, a rotating shaft inserted through the power device, the rotating plate disposed on the rotating shaft, the displacement plate having a center recess receiving the rotating plate, a first oblong hole, and a second oblong hole, the first oblong hole receiving a first support rod, the second oblong hole receiving a second support rod, a center rod disposed on the displacement plate, the fixed plate disposed on the power device, a support post disposed on a center of the fixed plate, the support post connected to an end of the drive plate, the drive plate having a plurality of teeth, an oblong slot formed on the drive plate, the center rod inserted in the oblong slot, the driven plate connected to the trunk, the driven plate having a plurality of serrations engaging with the teeth, a first vibration device disposed in a lower portion of the trunk, the first vibration device having two sector plates and two positioning devices disposed on the sector plates, two ends of a tension spring positioned by the positioning devices, each of the sector plates having a toothed edge, each of the sector plates connected to the respective pivot joint device, the sector plates engage with each other, a second vibration device disposed in an upper portion of the trunk, the second vibration device having two vibrating arms, two suspension posts connected to the vibrating arms, two pivot rods connected to the suspension posts, two gears disposed in the trunk, two rotating wheels disposed on the gears, two pinions disposed on the pivot rods, and a driven panel disposed in the trunk and between the gears, each of the rotating wheels having a serrated portion engaging with the pinions, and the driven panel having two serrated edges engaging with the gears.

* * * * *